US006295741B1

(12) United States Patent
Kita

(10) Patent No.: US 6,295,741 B1
(45) Date of Patent: Oct. 2, 2001

(54) ATHLETIC SHOE SOLE DESIGN AND CONSTRUCTION

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/546,455

(22) Filed: Apr. 10, 2000

(30) Foreign Application Priority Data

Apr. 16, 1999 (JP) ..... 11-108997

(51) Int. Cl.[7] ..... A43B 13/12

(52) U.S. Cl. ..... 36/30 R; 36/28; 36/31; 36/103

(58) Field of Search ..... 36/30 R, 31, 32 R, 36/102, 103, 4, 28, 107, 108, 27

(56) References Cited

U.S. PATENT DOCUMENTS

| | | | | |
|---|---|---|---|---|
| 2,677,906 | * | 5/1954 | Reed | 36/28 |
| 4,561,195 | * | 12/1985 | Onoda et al. | 36/30 R |
| 4,798,010 | * | 1/1989 | Sugiyama | 36/30 R |
| 4,805,319 | * | 2/1989 | Tonkel | 36/28 |
| 4,864,737 | * | 9/1989 | Marrello | 36/28 |
| 4,999,931 | * | 3/1991 | Vermeulen | 36/30 R |
| 5,131,173 | * | 7/1992 | Anderie | 36/25 R |
| 5,255,451 | * | 10/1993 | Tong et al. | 36/60 R |
| 5,606,807 | * | 3/1997 | Prepodnik | 36/86 |
| 5,720,118 | * | 2/1998 | Mayer et al. | 36/44 |
| 5,799,415 | * | 9/1998 | Kenji et al. | 36/44 |
| 6,219,940 | * | 4/2001 | Kita | 36/30 R |

FOREIGN PATENT DOCUMENTS

| | | | | |
|---|---|---|---|---|
| 19641866-A1 | * | 12/1996 | (DE) | 36/29 |
| 2032760-A | * | 5/1980 | (GB) | 36/30 R |
| 11-332606 | | 7/1999 | (JP) . | |
| WO-90/06699 | * | 6/1990 | (WO) | 36/28 |

* cited by examiner

*Primary Examiner*—Paul T. Sewell
*Assistant Examiner*—Anthony Stashick
(74) *Attorney, Agent, or Firm*—W. F. Fasse; W. G. Fasse

(57) ABSTRACT

This invention provides a sole assembly for an athletic shoe where the manufacturing process is simplified. The sole assembly includes a midsole body extending from the heel part to the forefoot part of a shoe, a corrugated sheet bonded to the bottom surface of the midsole body, and a lower midsole bonded to the heel portion of the corrugated sheet. A corrugation is formed at the heel portion of the corrugated sheet and an outsole on the forefoot side is integrally formed with the forefoot portion of the corrugated sheet. An outsole on the heel side is bonded to the bottom surface of the lower midsole.

9 Claims, 6 Drawing Sheets

ATHLETIC SHOE SOLE DESIGN AND CONSTRUCTION

BACKGROUND OF THE INVENTION

The present invention relates to a sole assembly. More particularly, the invention relates to the improvement of the sole construction, which is comprised of a midsole, a corrugated sheet, and an outsole.

The sole of an athletic shoe used for various sports is generally comprised of a midsole and an outsole. The midsole is typically formed of soft elastic material in order to ensure adequate cushioning properties. The outsole is fitted under the midsole and directly contacts with the ground.

Running stability as well as adequate cushioning properties is required in athletic shoes. There is need to prevent shoes from being deformed excessively in the lateral or transverse direction when contacting with the ground.

As shown in Japanese patent application publication No. 11-332606, filed May 22, 1998, published after the priority date, Apr. 16, 1999, of the present application, the applicant of the present invention proposes a midsole assembly having a corrugated sheet therein, which can prevent such an excessive lateral deformation of shoes.

FIGS. 5 and 6 show the midsole of the above Japanese patent application. As shown in FIGS. 5 and 6, a midsole 13 is comprised of an upper midsole 13*a* and lower midsoles 13*b*, 13*b*′. A corrugated sheet 14 is inserted between the upper midsole 13*a* and lower midsoles 13*b*, 13*b*′.

The corrugated sheet 14 extends from the heel portion to the center of the forefoot portion of a shoe and the upper midsole 13*a* is bonded to the upper face of the sheet 14. The lower midsoles 13*b*, 13*b*′ are bonded to the heel portion and forefoot portion, respectively, of the corrugated sheet 14. The lower midsole 13*b*′ is also attached to the upper midsole 13*a*. Under the lower midsoles 13*b*, 13*b*′ are attached outsoles 15, 15', respectively.

Such a construction produces resistant force which prevents the heel portion of a midsole from being deformed laterally or transversely when a shoe contacts with the ground. Thereby, the transverse deformation of the heel portion of a shoe is prevented and running stability is secured.

However, in this case, when manufacturing the above-mentioned sole construction, it is necessary to bond the lower midsole 13*b* to the heel portion of the corrugated sheet 14 and to bond the lower midsole 13*b*′ to the forefoot portion of the corrugated sheet 14. Furthermore, attachment of the outsole 15 to the lower midsole 13*b* as well as attachment of the outsole 15' to the lower midsole 13*b*′ is required, which makes the manufacturing process rather complicated.

The main object of the present invention is to provide a sole assembly for an athletic shoe that can simplify the manufacturing process.

SUMMARY OF THE INVENTION

The present invention is directed to a sole assembly for an athletic shoe. In a preferred embodiment, the sole assembly comprises a midsole body extending from the heel part to the forefoot part of the shoe, a corrugated sheet or wavy sheet having a heel portion and a forefoot portion, and a lower midsole attached to the heel portion of the corrugated sheet. The corrugated sheet is made of elastic material. At least the heel portion of the corrugated sheet has a corrugation and the forefoot portion of the corrugated sheet is integrally formed with the outsole on the forefoot side. The heel and forefoot portions of the corrugated sheet are attached to the bottom surface of the midsole body, and an outsole is attached under the lower midsole. The corrugated sheet is preferably made of elastomer. The elastomer may be polyurethane elastomer, polyamide elastomer, polyolefine elastomer, polystyrene elastomer, or polyester elastomer. More preferably, the corrugated sheet is made of solid rubber. The solid rubber may be styrene-butadiene-rubber, chloroprene-rubber, isoprene-rubber, butadiene-rubber, nitrile-rubber, or natural rubber. The solid rubber preferably has a Shore hardness of from 50 to 85 at A scale. More preferably, the Shore hardness of the solid rubber is 55±5 at A scale.

According to the present invention, the outsole on the forefoot side is integrated with the forefoot portion of the corrugated sheet. Such an integrated molding is more easily conducted by making the corrugated sheet of solid rubber. The manufacturing process of the sole construction of the present invention is as follows:

First, a corrugated sheet having a forefoot portion integrated with an outsole on the forefoot side is attached to the bottom surface of a midsole body. Thereafter, a lower midsole is attached to the heel portion of the corrugated sheet and then, an outsole on the heel side is attached to the bottom surface of the lower midsole.

Thus, the present invention not only eliminates the process of bonding the lower midsole to the forefoot portion, but it also eliminates the process of bonding the outsole to the forefoot portion of a shoe, which causes the number of parts to be reduced and causes the manufacturing process to be simplified.

Moreover, because the outsole and corrugated sheet are integrally formed with each other on the forefoot side of the midsole body, when the sole construction bends, peal of the outsole will not occur by the peal stress generated on the boundary between the outsole and corrugated sheet.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
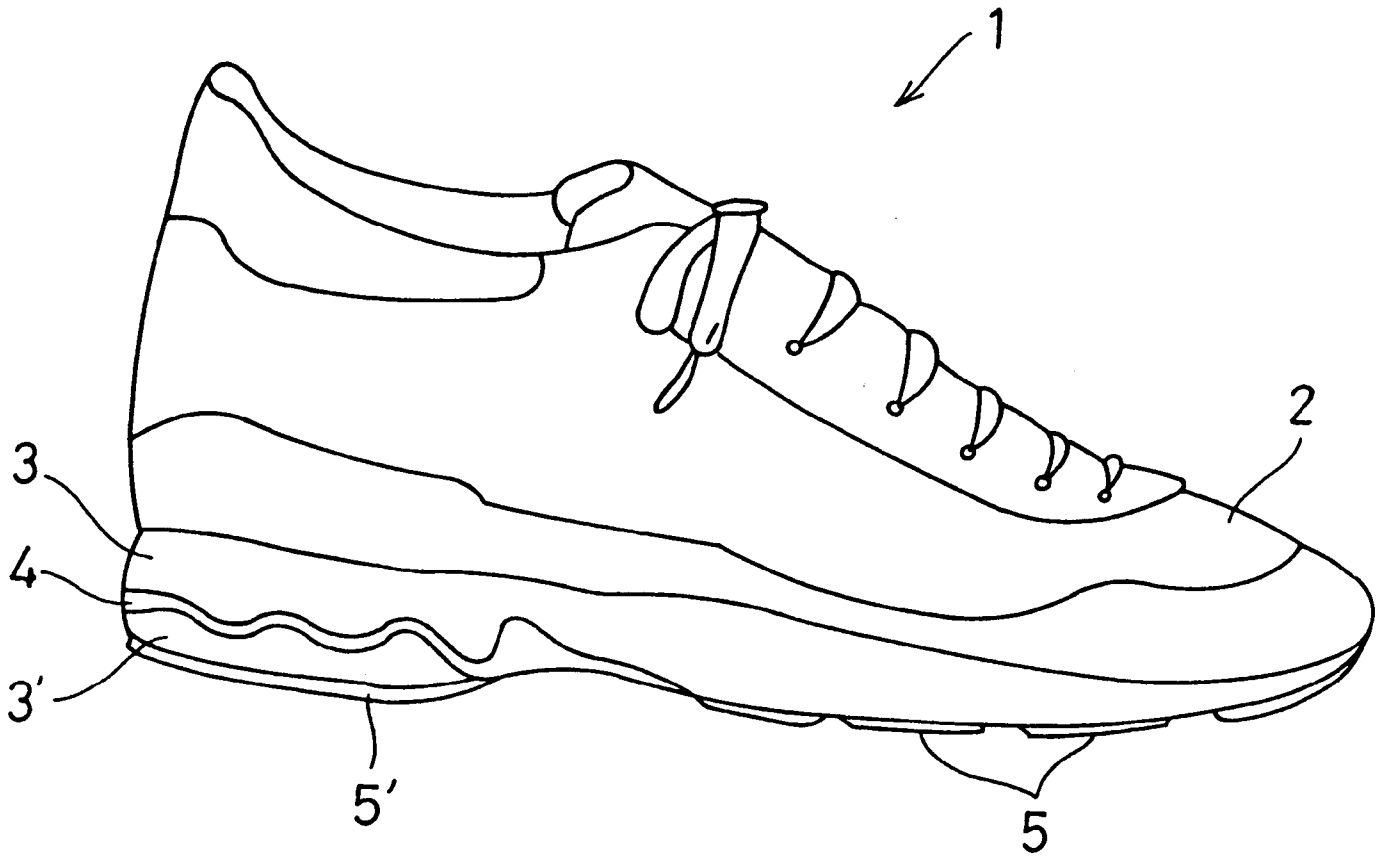
FIG. 1 is a side view of an athletic shoe incorporating the sole construction of the preferred embodiment of the present invention.
Figure 2:
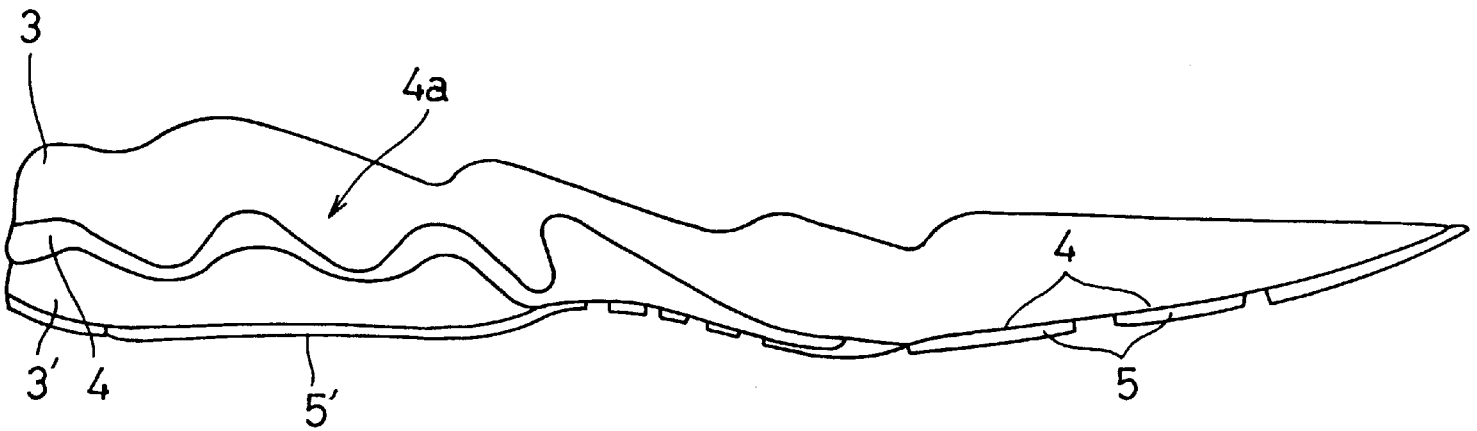
FIG. 2 is an enlarged side view of the sole construction of FIG. 1.
Figure 3:
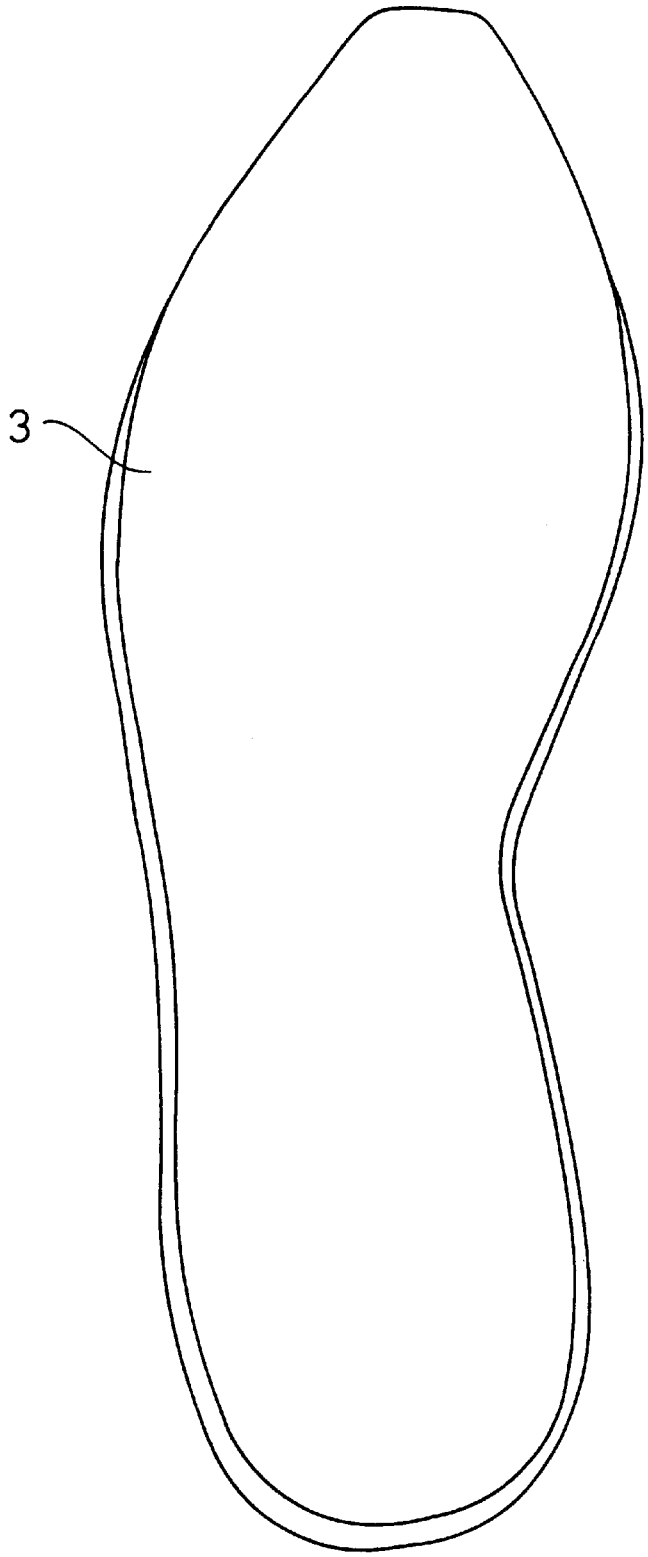
FIG. 3 is a top plan view of the sole construction of FIG. 1.

Turning now to the drawings, FIGS. 1 to 4 illustrate the sole construction of the present invention. As shown in FIGS. 1 to 3, a sole of an athletic shoe 1 comprises a midsole body 3 provided under an upper 2 and extending from the heel part to the forefoot part of the shoe 1, a corrugated sheet 4 placed at the bottom of the midsole body 3, a lower midsole 3' placed at the heel portion of the corrugated sheet 4, and outsoles 5, 5' directly contacting with the ground. The outsole 5 is provided at the bottom of the forefoot portion of the corrugated sheet 4. The outsole 5' is provided at the bottom of the lower midsole 3'.

The midsole body 3 and the lower midsole 3' are provided in order to absorb a shock load imparted on the heel part of the shoe 1 when an athlete lands on the ground.

The midsole body 3 and the lower midsole 3' are generally formed of soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used to form the midsole body 3 and the lower midsole 3'.

The corrugated sheet 4 extends from the heel part to the forefoot part of the shoe 1 in the same manner as the midsole body 3. The upper surface of the corrugated sheet 4 is bonded to the lower surface of the midsole body 3. The corrugated or wavy portion 4*a* is formed at the heel portion of the corrugated sheet 4. The outsole 5 is integrally formed with the bottom surface of the forefoot portion of the corrugated sheet 4.

Figure 4:
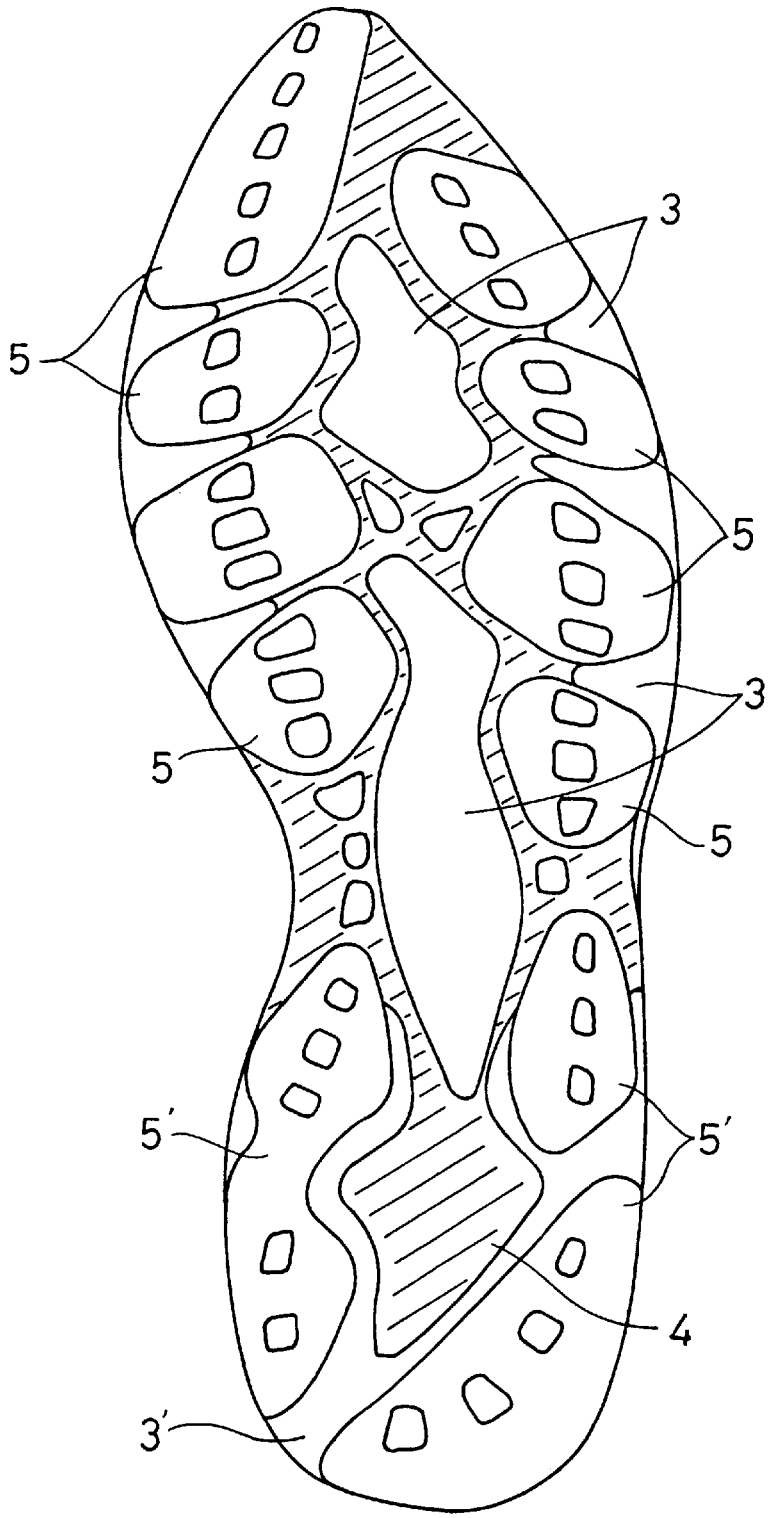
FIG. 4 is a bottom view of the sole construction of FIG. 1.
Figure 5:
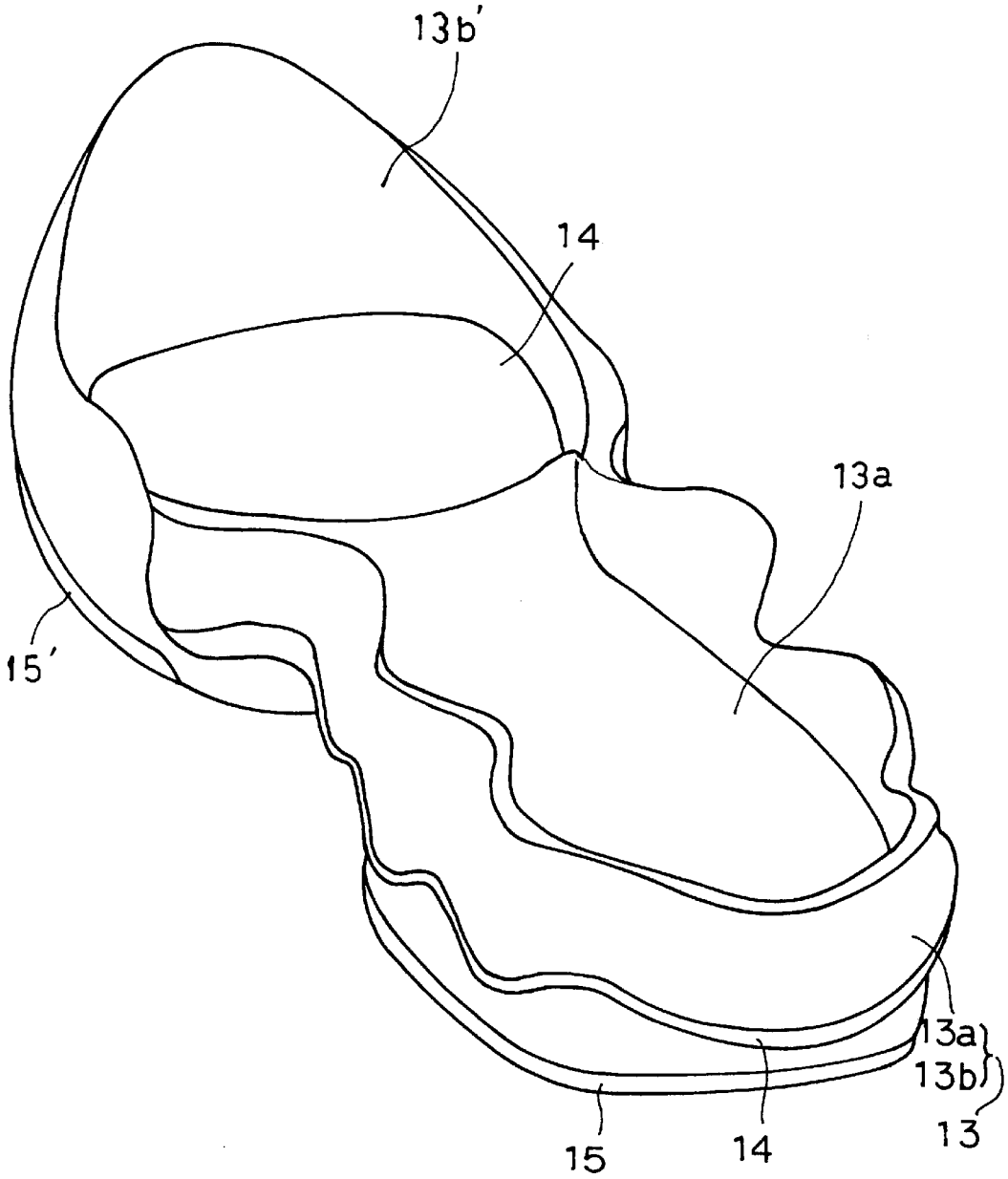
FIG. 5 is a perspective view of a midsole assembly proposed by the applicant of the present invention.
Figure 6:
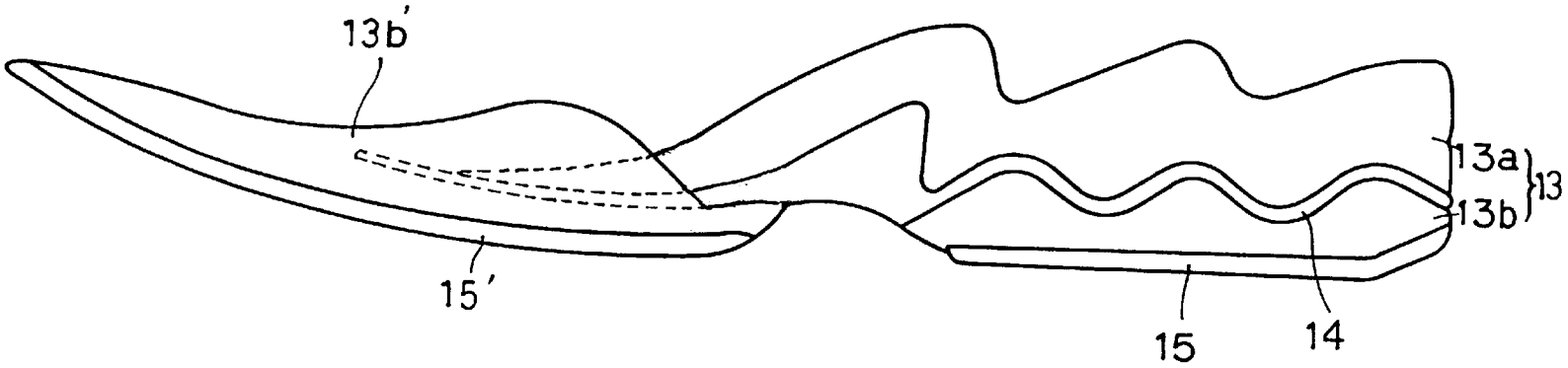
FIG. 6 is a side view of a midsole assembly proposed by the applicant of the present invention.

The outsole 5 is comprised of several parts, as is clearly seen in FIG. 4. In addition, slip preventing grooves or protrusions (not shown) are provided at the contact face of the outsole 5.

The corrugated sheet 4 and the outsole 5 are made of solid rubber. The solid rubber may be styrene-butadiene-rubber, chloroprene-rubber, isoprene-rubber, butadiene-rubber, nitrile-rubber, or natural rubber. The Shore hardness of the solid rubber is 50 to 85, preferably 55±5, at A scale. In this case, at the time of forming the corrugated sheet 4, the outsole 5 is easily formed integrally with the corrugated sheet 4. In addition, the corrugated sheet 4 may be formed of rubber material or elastic material different from the outsole 5. Furthermore, the corrugated sheet may be formed of elastomer such as polyurethane-elastomer, polyamide elastomer, polyolefine elastomer, polystyrene elastomer, or polyester elastomer.

The lower midsole 3' is bonded to the bottom surface of the heel portion of the corrugated sheet 4. The outsole 5' is bonded to the bottom surface of the lower midsole 3'. The outsole 5' is also made of solid rubber. Slip preventing grooves or protrusions (not shown) are provided at the contact face of the outsole 5'.

The manufacturing process of the sole construction of the present invention is as follows:

First, a corrugated sheet 4 having a forefoot portion integrated with an outsole 5 is bonded to the bottom surface of the midsole body 3. Thereafter, a lower midsole 3' is bonded to the heel portion of the corrugated sheet 4 and then, an outsole 5' is bonded to the bottom face of the lower midsole 3'.

In this way, the present invention not only eliminates the process of bonding the lower midsole to the forefoot portion, but it also eliminates the process of bonding the outsole 5 to the forefoot portion of the shoe 1, which causes the number of parts to be reduced and the manufacturing process to be simplified.

Moreover, because the outsole 5 and corrugated sheet 4 are formed integrally with each other on the forefoot side of the midsole body 3, when the sole construction bends, peal of the outsole will not occur by the peal stress generated on the boundary between the outsole 5 and corrugated sheet 4.

In addition, when a shoe 1 lands on the ground, the heel portion of the midsole tends to be less deformed in the transverse direction due to the action of the corrugated portion 4*a* of the corrugated sheet 4. Thereby, lateral movement of the heel portion of the shoe 1 can be prevented and running stability can be ensured.

The corrugated portion of the corrugated sheet 4 may be formed not only at the heel part but at the forefoot part of the shoe 1.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet still fall within the scope of the invention.

What is claimed is:

1. A sole assembly for an athletic shoe comprising:

a midsole body extending from the heel part to the forefoot part of said shoe;

a corrugated sheet made of elastic material, said sheet having a heel portion and a forefoot portion, at least said heel portion of said sheet having a corrugation, an outsole on the forefoot side being integrally formed with said forefoot portion of said sheet, said heel and forefoot portions of said sheet being bonded to the bottom surface of said midsole body; and a lower midsole being bonded to the heel portion of said corrugated sheet, an outsole on the heel side being bonded to the bottom surface of said lower midsole.

2. The sole assembly of claim 1, wherein said elastic material is solid rubber.

3. The sole assembly of claim 1, wherein said elastic material is elastomer.

4. The sole assembly of claim 2, wherein said solid rubber is any one of the rubber selected from the group of rubber consisting essentially of styrene-butadiene-rubber, chloroprene-rubber, isoprene-rubber, butadiene-rubber, nitrile-rubber, and natural rubber.

5. The sole assembly of claim 3, wherein said elastomer is any one of the elastomer selected from the group of elastomer consisting essentially of polyurethane elastomer, polyamide elastomer, polyolefine elastomer, polystyrene elastomer, and polyester elastomer.

6. The sole assembly of claim 2, wherein said solid rubber has a Shore hardness of from 50 to 85 at A scale.

7. The sole assembly of claim 2, wherein said solid rubber has a Shore hardness of 55±5 at A scale.

8. The sole assembly of claim 3, wherein said elastomer has a Shore hardness of from 50 to 85 at A scale.

9. The sole assembly of claim 3, wherein said elastomer has a Shore hardness of 55±5 at A scale.

* * * * *